US011676565B2

(12) United States Patent
Pachet et al.

(10) Patent No.: US 11,676,565 B2
(45) Date of Patent: Jun. 13, 2023

(54) AUTOMATIC PREPARATION OF A NEW MIDI FILE

(71) Applicant: Spotify AB, Stockholm (SE)

(72) Inventors: François Pachet, Paris (FR); Pierre Roy, Paris (FR)

(73) Assignee: Spotify AB, Stockholm (SE)

( * ) Notice: Subject to any disclaimer, the term of this patent is extended or adjusted under 35 U.S.C. 154(b) by 256 days.

(21) Appl. No.: 17/080,654

(22) Filed: Oct. 26, 2020

(65) Prior Publication Data

US 2021/0158791 A1 May 27, 2021

Related U.S. Application Data

(60) Provisional application No. 63/054,148, filed on Jul. 20, 2020.

(30) Foreign Application Priority Data

Nov. 21, 2019 (EP) ..... 19210729

(51) Int. Cl.
*G10H 5/02* (2006.01)

(52) U.S. Cl.
CPC ..... *G10H 5/02* (2013.01)

(58) Field of Classification Search
CPC ..... G10H 1/0025; G10H 1/0008; G10H 2210/066; G10H 1/00; G10H 1/0066;
(Continued)

(56) References Cited

U.S. PATENT DOCUMENTS 5,663,517 A 9/1997 Oppenheim
9,286,876 B1 * 3/2016 Dabby ..... B42D 15/022
(Continued)

FOREIGN PATENT DOCUMENTS

CN 10205399 A 5/2011
CN 110246472 A 9/2019
(Continued)

OTHER PUBLICATIONS

Spotify AB, Extended European Search Report, EP19210729.0, dated Apr. 30, 2020, 26 pgs.
(Continued)

*Primary Examiner* — Marlon T Fletcher
(74) *Attorney, Agent, or Firm* — Morgan, Lewis & Bockius LLP

(57) ABSTRACT

The present disclosure relates to a method of automatically preparing a MIDI file based on a target MIDI file comprising respective note information about each of a plurality of target notes and a source MIDI file comprising respective note information about each of a plurality of source notes. Each note information comprises pitch information defining a pitch of the note. The method comprises ranking the plurality of target notes based on the pitch of each target note. The method also comprises, for each of the ranked target notes, removing the pitch information from the note
(Continued)

information of the target note. The method also comprises, for each of the ranked target notes, replacing the removed pitch information with pitch information of a corresponding source note, whereby the target note has the same pitch as the corresponding source note, forming a plurality of new notes of a new MIDI file.

20 Claims, 5 Drawing Sheets

(58) Field of Classification Search
CPC ..... G10H 2240/056; G10H 2240/131; G10H 2210/331; G10H 2210/111; G10H 2240/145; G10H 2210/105; G10H 2210/081; G10H 2240/311; G10H 2210/071; G10H 2210/341; G10H 2240/021; G10H 2210/101; G10H 2210/161; G10H 1/18; G10H 2210/555; G10H 2240/031; G10H 2240/115; G10H 2210/325; G10H 2240/011
See application file for complete search history.

(56) References Cited

U.S. PATENT DOCUMENTS

| | | | | |
|---|---|---|---|---|
| 2013/0125732 | A1* | 5/2013 | Nguyen | G10H 1/0025 84/609 |
| 2019/0164446 | A1 | 5/2019 | Humphrey | |
| 2021/0125593 | A1* | 4/2021 | Pachet | G10H 1/0066 |

FOREIGN PATENT DOCUMENTS

| | | | | |
|---|---|---|---|---|
| EP | 0143578 | A2 | 6/1985 | |
| EP | 3816989 | A1 * | 5/2021 | G10H 1/0025 |
| EP | 3826000 | A1 * | 5/2021 | G10H 1/0025 |

OTHER PUBLICATIONS

Spotify AB, Extended European Search Report, EP21214833.2, dated Mar. 14, 2022, 31 pgs.
Spotify AB, Intention to Grant, EP19210729.0, dated Aug. 16, 2021, 6 pgs.
Spotify AB, Decision to Grant, EP19210729.0, dated Dec. 2, 2021, 2 pgs.

* cited by examiner

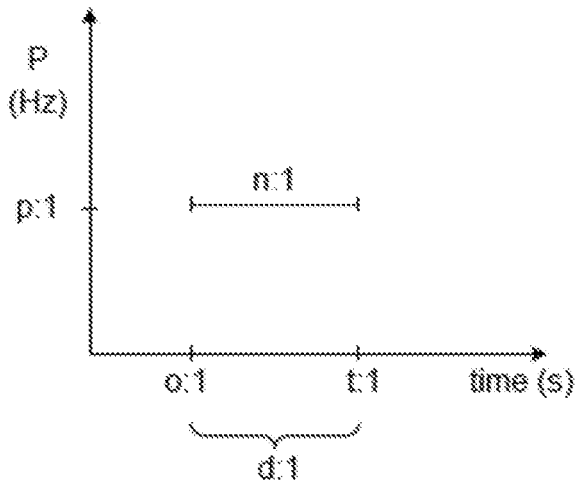
Fig. 1
| **n** Note | **p** (Hz) Pitch/ Frequency value | **o** (s) Time onset | **d** (s) Time duration | **v** (dB) Velocity/ Relative loudness |
|---|---|---|---|---|
| n:1 | p:1 | o:1 | d:1 | v:1 |
| n:2 | p:2 | o:2 | d:2 | v:2 |
| n:3 | p:3 | o:3 | d:3 | v:3 |
| n:4 | p:4 | o:4 | d:4 | v:4 |
| n:5 | p:5 | o:5 | d:5 | v:5 |
| n:6 | p:6 | o:6 | d:6 | v:6 |
| n:7 | p:7 | o:7 | d:7 | v:7 |
| n:8 | p:8 | o:8 | d:7 | v:8 |
Fig. 2
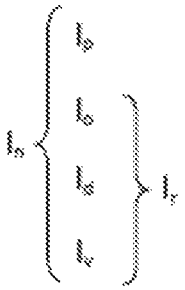
Fig. 3
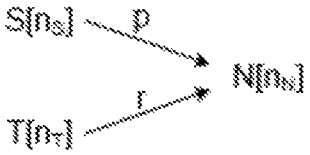
Fig. 4

| $L_T$ Target list of $p_T$ | $L_S$ Source list of $p_S$ |
|---|---|
| $p_T$:3 | $p_S$:7 |
| $p_T$:8 | $p_S$:2 |
| $p_T$:1 | $p_S$:8 |
| $p_T$:6 | $p_S$:1 |
| $p_T$:2 | $p_S$:5 |
| $p_T$:4 | $p_S$:4 |
| $p_T$:5 | $p_S$:3 |
| $p_T$:7 | $p_S$:6 |

Fig. 5

| $n_N$ Notes of new MIDI file | | | | |
|---|---|---|---|---|
| $n_N$:1 | $p_S$:8 | $o_T$:1 | $d_T$:1 | $v_T$:1 |
| $n_N$:2 | $p_S$:5 | $o_T$:2 | $d_T$:2 | $v_T$:2 |
| $n_N$:3 | $p_S$:7 | $o_T$:3 | $d_T$:3 | $v_T$:3 |
| $n_N$:4 | $p_S$:4 | $o_T$:4 | $d_T$:4 | $v_T$:4 |
| $n_N$:5 | $p_S$:3 | $o_T$:5 | $d_T$:5 | $v_T$:5 |
| $n_N$:6 | $p_S$:1 | $o_T$:6 | $d_T$:6 | $v_T$:6 |
| $n_N$:7 | $p_S$:6 | $o_T$:7 | $d_T$:7 | $v_T$:7 |
| $n_N$:8 | $p_S$:2 | $o_T$:8 | $d_T$:8 | $v_T$:8 |

Fig. 6

AUTOMATIC PREPARATION OF A NEW MIDI FILE

RELATED APPLICATIONS

This application claims priority to U.S. Prov. App. No. 63/054,148, filed Jul. 20, 2020, and European App. No. EP19210729, filed Nov. 21, 2019, each of which is hereby incorporated by reference in its entirety.

TECHNICAL FIELD

The present disclosure relates to automatically preparing a Musical Instrument Digital Interface (MIDI) file.

BACKGROUND

A piano roll, e.g. of a MIDI file, contains notes, each of which is defined by:

Onset and duration (Time dimension).

Pitch (Frequency dimension).

Loudness/Velocity.

Optionally, timbre information, e.g., instrument name.

A rhythm is obtained by ignoring the pitch information.

SUMMARY

It is an objective of the present invention to provide a new MIDI file based on a source MIDI file and a target MIDI file. In accordance with some embodiments of the present invention, the new MIDI file may be regarded as a re-harmonisation of the target MIDI file, using pitches based on the source MIDI file.

According to an aspect of the present invention, there is provided a method of automatically preparing a MIDI file based on a target MIDI file comprising respective note information about each of a plurality of target notes of the target MIDI file and a source MIDI file comprising respective note information about each of a plurality of source notes of the source MIDI file. Each note information, of both target and source notes, comprises pitch information defining a pitch of the note. The method comprises ranking the plurality of target notes based on the pitch of each target note. The method also comprises, for each of the ranked target notes, removing the pitch information from the note information of said ranked target note. The method also comprises, for each of the ranked target notes, replacing the removed pitch information with pitch information of a corresponding source note, whereby said target note has the same pitch as the corresponding source note (since the pitch information is now the same as for the corresponding source note), forming a plurality of new notes of a new MIDI file. Thus, each new note has a pitch of a corresponding source note.

According to another aspect of the present invention, there is provided a computer program product (e.g. a non-transitory computer readable storage medium) comprising computer-executable components for causing an electronic device to perform an embodiment of the method of the present disclosure when the computer-executable components are run on processing circuitry comprised in the electronic device.

According to another aspect of the present invention, there is provided an electronic device configured for performing an embodiment of the method of the present disclosure. Thus, the electronic device is configured for automatically preparing a MIDI file based on a target MIDI file comprising respective note information about each of a plurality of target notes of the target MIDI file and a source MIDI file comprising respective note information about each of a plurality of source notes of the source MIDI file. Each note information comprises pitch information defining a pitch of the note. The electronic device comprises processing circuitry, and data storage storing instructions executable by said processing circuitry whereby said electronic device is operative to rank the plurality of target notes based on the pitch of each target note; for each of the ranked target notes, remove the pitch information from the note information of the target note; and for each of the ranked target notes, replace the removed pitch information with pitch information of a corresponding source note, whereby the target note has the same pitch as the corresponding source note, forming a plurality of new notes of a new MIDI file.

By exchanging the pitch information of the target notes with pitch information of the source notes, the rhythm of the target MIDI file may be maintained while being re-harmonized with the source notes. Thus, a new MIDI file is automatically provided based on the source and target MIDI files. The new MIDI file may be outputted and played.

Embodiments of the method of the present disclosure may be regarded as a type of style or rhythm transfer. Style transfer has previously been proposed for images, e.g. "A Neural Algorithm for Artistic Style", Gatys et al., using convolutional networks. Style Transfer has also been applied to symbolic music, using Generative Adversarial Networks (GANs), e.g. "Symbolic Music Genre Transfer with CycleGAN", Brunner et al. However, the present invention is more specific in that harmony (pitches) and rhythm are transferred to a new note sequence of a new MIDI file. In practice, the results may be more musical (i.e. no wrong notes may be provided). Also, in some embodiments of the present invention, the invention works on single source and target MIDI files (no need for training on large datasets), and the result may be more predictable e.g. by a user. Also, parameters are natural, and may allow users to experiment with many meaningful combinations.

It is to be noted that any feature of any of the aspects may be applied to any other aspect, wherever appropriate. Likewise, any advantage of any of the aspects may apply to any of the other aspects. Other objectives, features and advantages of the enclosed embodiments will be apparent from the following detailed disclosure, from the attached dependent claims as well as from the drawings.

Generally, all terms used in the claims are to be interpreted according to their ordinary meaning in the technical field, unless explicitly defined otherwise herein. All references to "a/an/the element, apparatus, component, means, step, etc." are to be interpreted openly as referring to at least one instance of the element, apparatus, component, means, step, etc., unless explicitly stated otherwise. The steps of any method disclosed herein do not have to be performed in the exact order disclosed, unless explicitly stated. The use of "first", "second" etc. for different features/components of the present disclosure are only intended to distinguish the features/components from other similar features/components and not to impart any order or hierarchy to the features/components.

BRIEF DESCRIPTION OF THE DRAWINGS

The embodiments disclosed herein are illustrated by way of example, and not by way of limitation, in the figures of the accompanying drawings. Like reference numerals refer to corresponding parts throughout the drawings and specification.

FIG. 1 is a schematic graph illustrating properties of a note, in accordance with an embodiment of the present invention.

FIG. 2 is a table illustrating properties of notes of a MIDI file, in accordance with an embodiment of the present invention.

FIG. 3 illustrates note information which may be stored in a MIDI file, in accordance with an embodiment of the present invention.

FIG. 4 illustrates how a new MIDI file can be formed by the rhythm of a target MIDI file in combination with pitches of a source MIDI file, in accordance with an embodiment of the present invention.

FIG. 5 is a table illustrating source and target lists of pitches, in accordance with an example embodiment of the present invention.

FIG. 6 is a table illustrating properties of notes of a new MIDI file automatically prepared based on the source and target lists of FIG. 5, in accordance with an example embodiment of the present invention.

DETAILED DESCRIPTION

Figure 7:
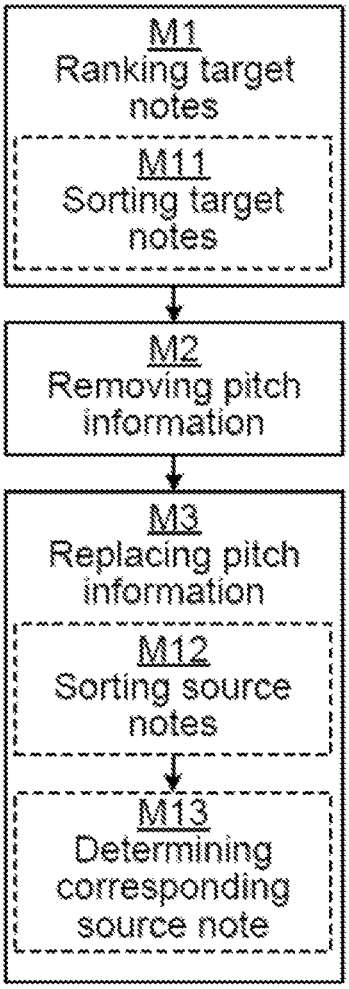
FIG. 7 is a schematic flow chart of an embodiment of a method of the present invention.

Embodiments will now be described more fully hereinafter with reference to the accompanying drawings, in which certain embodiments are shown. However, other embodiments in many different forms are possible within the scope of the present disclosure. Rather, the following embodiments are provided by way of example so that this disclosure will be thorough and complete, and will fully convey the scope of the disclosure to those skilled in the art. Like numbers refer to like elements throughout the description.

It is noted that when it is herein referred to MIDI files, it is often the audio (e.g. sequence of notes) encoded by the MIDI file which is intended. The length of a MIDI file, or a segment thereof, may thus be regarded as e.g. the number of bars or beats of the audio encoded thereby, or a time duration of the audio when played at a predetermined tempo.

FIG. 1 illustrates properties of a note n of a MIDI file, here a first note n:1, in a two-dimensional graph with time on the x-axis and pitch (frequency) on the y-axis. In this two-dimensional system, the note n:1 may be defined with a pitch p:1, and its extension in time can be defined by any two of the properties onset o:1, termination t:1 and duration d:1. In addition, the note may be defined by velocity (i.e. relative loudness) v:1 (see FIG. 2) and, optionally, timbre (e.g. defined by type of instrument).

The table of FIG. 2 illustrates how each note n of a sequence of notes, here eight notes n:1-*n*-8, is defined by properties of pitch p, time onset o, time duration d and velocity v. Information I about these different properties may be stored in a MIDI file.

FIG. 3 illustrates that note information $I_n$ of each note n, e.g. each of the notes n:1-*n*-8 of the sequence presented in FIG. 2, comprises pitch information $I_p$, onset information $I_o$, duration information $I_d$ and velocity information $I_v$. As discussed above, the rhythm of a sequence of notes can be defined as the properties of the notes without the pitch p. Thus, rhythm information $I_r$ of a note corresponds to the note information In without the pitch information $I_p$, in this example corresponding to the onset information $I_o$, the duration information $I_d$ and the velocity information $I_v$.

FIG. 4 illustrates how a new MIDI file N, having a sequence of new notes $n_N$, is formed from a combination of a target MIDI file T, having a sequence of target notes $n_T$, and a source MIDI file S, having a sequence of source notes $n_S$. In accordance with embodiments of the present invention, the new MIDI file N comprises the rhythm r from the target MIDI file T and the pitches p from the source MIDI file S.

In accordance with embodiments of the present invention, the new MIDI file N has the same (preferably exactly the same) rhythm r as the target MIDI file T. This implies that the sequence of notes n in the new MIDI file N may be the same as in the target MIDI file, and that the notes retain the same properties as in the target MIDI file T, e.g. onset o, duration d and velocity v, except for the pitch p. Optionally, additional property(ies), e.g. timbre, may be included in the rhythm r which is maintained between the new and target MIDI files. However, optionally, there may also be other property(ies) of the notes n, other than pitch p, which are not included in the maintained rhythm r.

In accordance with embodiments of the present invention, the pitches p of the new MIDI file N are based on the pitches of the source MIDI file S, they are preferably the same as the pitches of the notes of the source MIDI file, but typically not in the same order as in the note sequence of the source MIDI file. Thus, embodiments of the present invention may be regarded as including pitch substitution in the target MIDI file T by pitches of the source MIDI file S. The substitution may be done by mapping, which preferably finds a reasonable trade-off between the pitch distribution of the source and target MIDI files, which may be completely different, and the respective ranking (e.g. high to low or low to high) of the pitches of the source and target MIDI files, e.g. such that low pitches of the target MIDI file are substituted by low pitches of the source MIDI file and high pitches of the target MIDI file are substituted by high pitches of the source MIDI file. More generally, by means of embodiments of the present invention, harmonic (pitch) and rhythmic information from any two MIDI files (called source and target MIDI files herein) may be mixed to produce a new MIDI file N.

Different automated approaches may be used for achieving the pitch substitution. One approach, herein called the naïve method, may (with reference to FIGS. 5 and 6) include the following steps:

- Ranking the target notes $n_T$ by sorting the target notes, typically in ascending or descending order, based on the pitch $p_T$ of each of the notes to form a target list $L_T$.
- For each of the ranked target notes, removing the pitch information $I_p$ from the note information $I_n$ of the target note.
- Sorting the source notes $n_S$, typically in ascending or descending order (same as for the sorting of the plurality of target notes $n_T$) based on the pitch p of each of the source notes to form a source list $L_S$. This may be done before, after or concurrently with the ranking of the target notes and/or the removing of pitch information from the target notes.
- For each of the target notes in the target list $L_T$, replacing the removed pitch information $I_P$ with the pitch information of the corresponding source note with the same rank in the source list $L_S$.

In the example of FIGS. 5 and 6, the target pitches $p_T$:1-$p_T$:8 of the sequence of target notes $n_T$:1-$n_T$:8 are ranked in ascending order in a target list $L_T$. Similarly, the source pitches $p_S$:1-$p_S$:8 of the sequence of source notes $n_S$:1-$n_S$:8 are ranked in ascending order in a source list $L_S$. Then, for each of the target notes, the pitch information $I_p$ of the source note of the same rank in the lists $L_T$ and $L_S$ is included with the note information $I_n$ of the target note. For example, in accordance with FIG. 5, the pitch information of the $7^{th}$ source note $n_S$:7 is added to the note information of the $3^{rd}$ target note $n_T$:3, etc. Thus, respective note information of new notes $n_N$ of the new MIDI file N are formed, the first new note $n_N$:1 comprising the rhythm information $I_r$ from the first target note $n_T$:1 and the pitch information $I_p$ from the $8^{th}$ source note ns:8, etc.

Then, when the new notes $n_N$ are reordered in the same order as the original sequence of the target notes $n_T$ in the target MIDI file T, to form a sequence of new notes $n_N$:1-$n_N$:8, the properties of the new notes are as presented in the table of FIG. 6, and the new MIDI file is formed by the sequence of new notes $n_N$:1-$n_N$:8.

Additionally or alternatively, an approach using another algorithm, e.g. utilizing machine learning, may be used. With such an algorithm, the replacing of the removed pitch information with pitch information from source notes may comprise determining a probability distribution of the plurality of source notes based on the pitch of each of the source notes, and determining for each of the sorted target notes $n_T$, its corresponding source note $n_S$ based on the determined probability distribution, wherein the determining of the probability distribution may be by means of a pre-trained model, e.g. comprising machine-learning such as neural networks.

In an example of a machine learning approach, the method may comprise the following steps:

- Ranking the target notes (e.g. by time/pitch lexicographic order).
- Removing the pitch information from the ordered target notes, thereby resulting in an ordered set of rhythmic placeholders.
- Sequentially assigning new pitch information to each of the placeholders by selecting a pitch value from a set of pre-selected pitch values obtained from the source pitches of the source notes (e.g. all the pitches from a specific subset of the source notes), where the selection process may comprise or consist of:
  - Computing a probability distribution over the set of pitches using a pre-trained model (e.g. using a neural network), which may e.g. take as input any of:
    - The previous and current rhythmic placeholders.
    - The pitch values already assigned to the previous rhythmic placeholders.
    - The set of source pitches.
  - Sampling from the probability distribution.

The pre-trained model may e.g. be trained in the following way:

- Create a training set: for a plurality of (typically a large number of) target MIDI files,
  - Rank the target notes in the target MIDI file (e.g. by time/pitch lexicographic order).
  - Remove the pitch information from the ranked target notes, thereby resulting in an ordered set of rhythmic placeholders and a set of target pitches.
- Train the model on the training set to perform the inference task described above, with its inputs being the (dissociated) rhythmic placeholders and the set of pitches from the same target notes, and where the ground truth data consists in the pitch information that was originally assigned to the respective target notes.

Generally, pitch (harmonic) information $I_p$ from the source MIDI file S is mixed with rhythm information $I_r$ from the target MIDI file T to automatically prepare the new MIDI file N.

In case the number of target notes is not the same as the number of source notes, notes can be added or removed from either the plurality of target notes or the plurality of source notes, such that the number of target notes is the same as the number of source notes. Removal of note(s) may be done randomly, or in any suitable non-random way. Added note(s) may e.g. be octave note(s) or any other note(s) e.g. which are more suitable for preserving the harmony of the source MIDI file. Generally, the replacing of the removed pitch information comprises: if the plurality of source notes $n_S$ contains a higher number of notes than the plurality of target notes $n_r$, removing, e.g. randomly, at least one source note from the plurality of source notes or adding at least one note, e.g. octave note, to the plurality of target notes such that the plurality of source notes contains the same number of notes as the plurality of target notes; or, if the plurality of source notes $n_S$ contains a lower number of notes than the plurality of target notes $n_r$, removing, e.g. randomly, at least one target note from the plurality of target notes or adding at least one note, e.g. octave note, to the plurality of source notes such that the plurality of source notes contains the same number of notes as the plurality of target notes.

In a more specific example, a pitch range, e.g. [m−8, M+8], is calculated, where m is the lowest pitch occurring among both the plurality of source and the plurality of target notes, respectively, and M is the maximum pitch occurring among both the plurality of source and the plurality of target notes, respectively. Then, a pitch p is determined for the plurality of source notes for which q=p+12 or q=p−12 such that $m-8 \leq q \leq M+8$. If such a pitch p is found, q is added to the source pitches (e.g. of the source list $L_S$). If more pitches need to be added, the algorithm can be repeated. If no such pitch p is found, a random pitch may instead be removed from the target pitches (e.g. of the target list $L_T$), thus simplifying the rhythm r in case when the plurality of source notes contains fewer notes, and thus source pitches, than the plurality of target notes.

In some embodiments of the present invention, the plurality of source notes are the notes of a segment of the source MIDI file S, and the plurality of target notes are the notes of a segment of the target MIDI file T, from which segments a segment of the new MIDI file N is formed. Embodiments of the method of the present disclosure may then be performed for any pair of one source segment and one target segment, e.g. till all source notes and all target notes of the source and target MIDI files have been processed in accordance with the method (i.e. have been included at least once in the pluralities of target and source notes discussed herein). For example, the method may be applied to each successive segment of the source MIDI file in combination with respective each successive segment of the target MIDI file, such that e.g. segment i of the source MIDI file is combined with segment i of the target MIDI file, e.g. regardless of the number of target and source segments. If the number of notes per segment is different in any pair, notes may be added or removed as discussed herein.

In case the number of source segments is not the same as the number of target segments, the mapping of segments to each other may be stretched so that all of both source and target segments are used at least once. This ensures that all notes (i.e. the note information $I_n$ thereof) in each file are processed with an embodiment of the method of the present disclosure. For instance, the shorter sequence of the notes (formed by the plurality of source or target notes) may be looped to form as many segments as the longer sequence.

A MIDI file (i.e. the sequence of notes n encoded thereby) may be segmented into only one segment (the whole file is then considered), or with regular segments of e.g. one beat, two beats, one bar, etc. The file can also be segmented with irregular segments.

A different segmentation can be used for each of the source and target MIDI files. For instance a source MIDI file in 3/4 can be segmented every three beats (1 bar), and if the target MIDI file is in 4/4 it can be segmented every four beats (also 1 bar). This may allow to use a rhythm/harmony in 4/4 and apply it to a 3/4 target.

Arbitrary combinations of segmenting schemes can be used, creating different results. A default segmenting scheme can be set (e.g. each two beats for both the source and the target MIDI files), but any other segmenting scheme may alternatively be used, e.g. by a musician who is experimenting.

When the method is applied to segments, then the successive results, i.e. the resulting sequence of new segments of the new MIDI file N, typically have to be concatenated to each other to produce a single new MIDI file.

FIG. 7 illustrates some embodiments of the method of the present disclosure. The method is for automatically preparing a MIDI file based on a target MIDI file T comprising respective note information $I_n$ about each of a plurality of target notes $n_T$ of the target MIDI file and a source MIDI file S comprising respective note information $I_n$ about each of a plurality of source notes $n_S$ of the source MIDI file. Each note information (of both source and target notes) comprises pitch information $I_p$ defining a pitch p of the note $n_T$ or $n_S$.

The method comprises ranking M1 the plurality of target notes $n_T$ based on the pitch p of each target note. In some embodiments, the ranking M1 comprises sorting M11 the plurality of target notes $n_T$ based on the pitch p of each of the target notes to form a target list $L_T$.

The method also comprises, for each of the ranked M1 target notes $n_T$, removing M2 the pitch information $I_p$ from the note information $I_n$ of the target note. However, the rhythm information $I_r$ of the target note $n_T$ typically remains part of the note information $I_n$ of said target note.

The method also comprises, for each of the ranked M1 target notes $n_T$, replacing M3 the removed M2 pitch information with pitch information $I_p$ of a corresponding source note $n_S$, whereby the target gets the same pitch p as the corresponding source note, forming a plurality of new notes $n_N$ of a new MIDI file N. Thus, the note information $I_n$ of each of the new notes $n_N$ of the note sequence of the new MIDI file N typically comprises rhythm information $I_r$ from a target note $n_T$ and pitch information $I_p$ from a corresponding source note $n_S$.

In some embodiments, the replacing M3 comprises sorting M12 the plurality of source notes $n_S$ based on the pitch p of each of the source notes to form a source list $L_S$, and for each of the sorted M11 target notes $n_T$, determining M13 its corresponding source note $n_S$ as the source note having the same rank in the source list as the target note has in the target list. Thus, the source note which has the same rank in the source list $L_S$, e.g. any of the ranks $1^{st}$ to $8^{th}$ of FIG. 5, as a target note in the target list $L_T$, e.g. any of the ranks $1^{st}$ to $8^{th}$ of FIG. 5, is regarded as the source note which is corresponding to said target note.

In some embodiments, the replacing M3 comprises determining M21 a probability distribution of the plurality of source notes based on the pitch p of each of the source notes, and for each of the sorted target notes $n_T$, determining M22 its corresponding source note $n_S$ based on the determined M21 probability distribution. In some embodiments, the determining M21 of the probability distribution is done by means of a pre-trained model, e.g. comprising machine-learning such as neural networks.

In some embodiments, typically independent on how the corresponding source notes are determined, the replacing M3 comprises: if the plurality of source notes $n_S$ contains a higher number of notes than the plurality of target notes $n_T$, removing, e.g. randomly, at least one source note from the plurality of source notes or adding at least one note, e.g. octave note, to the plurality of target notes such that the plurality of source notes contains the same number of notes as the plurality of target notes; or if the plurality of source notes $n_S$ contains a lower number of notes than the plurality of target notes $n_T$, removing, e.g. randomly, at least one target note from the plurality of target notes or adding at least one note, e.g. octave note, to the plurality of source notes such that the plurality of source notes contains the same number of notes as the plurality of target notes.

Figure 8:
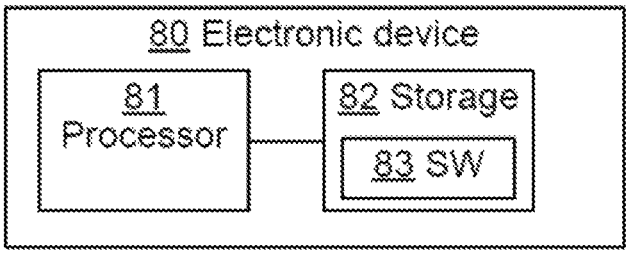
FIG. 8 is a schematic block diagram of an embodiment of an electronic device in accordance with some embodiments of the present invention.

FIG. 8 schematically illustrates an embodiment of an electronic device 80 in accordance with some embodiments of the present invention. The electronic device 80 comprises processing circuitry 81 e.g. a central processing unit (CPU). The processing circuitry 81 may comprise one or a plurality of processing units in the form of microprocessor(s). However, other suitable devices with computing capabilities could be comprised in the processing circuitry 81, e.g. an application specific integrated circuit (ASIC), a field programmable gate array (FPGA) or a complex programmable logic device (CPLD). The processing circuitry 81 is configured to run one or several computer program(s) or software (SW) 83 stored in a data storage 82 of one or several storage unit(s) e.g. a memory. The storage unit 82 may be regarded as a computer readable means, forming a computer program product together with the SW 83 stored thereon as computer-executable components, as discussed herein and may e.g. be in the form of a Random Access Memory (RAM), a Flash memory or other solid state memory, or a hard disk, or be a combination thereof. The processing circuitry 81 may also be configured to store data in the storage 82, as needed.

Figure 9A:
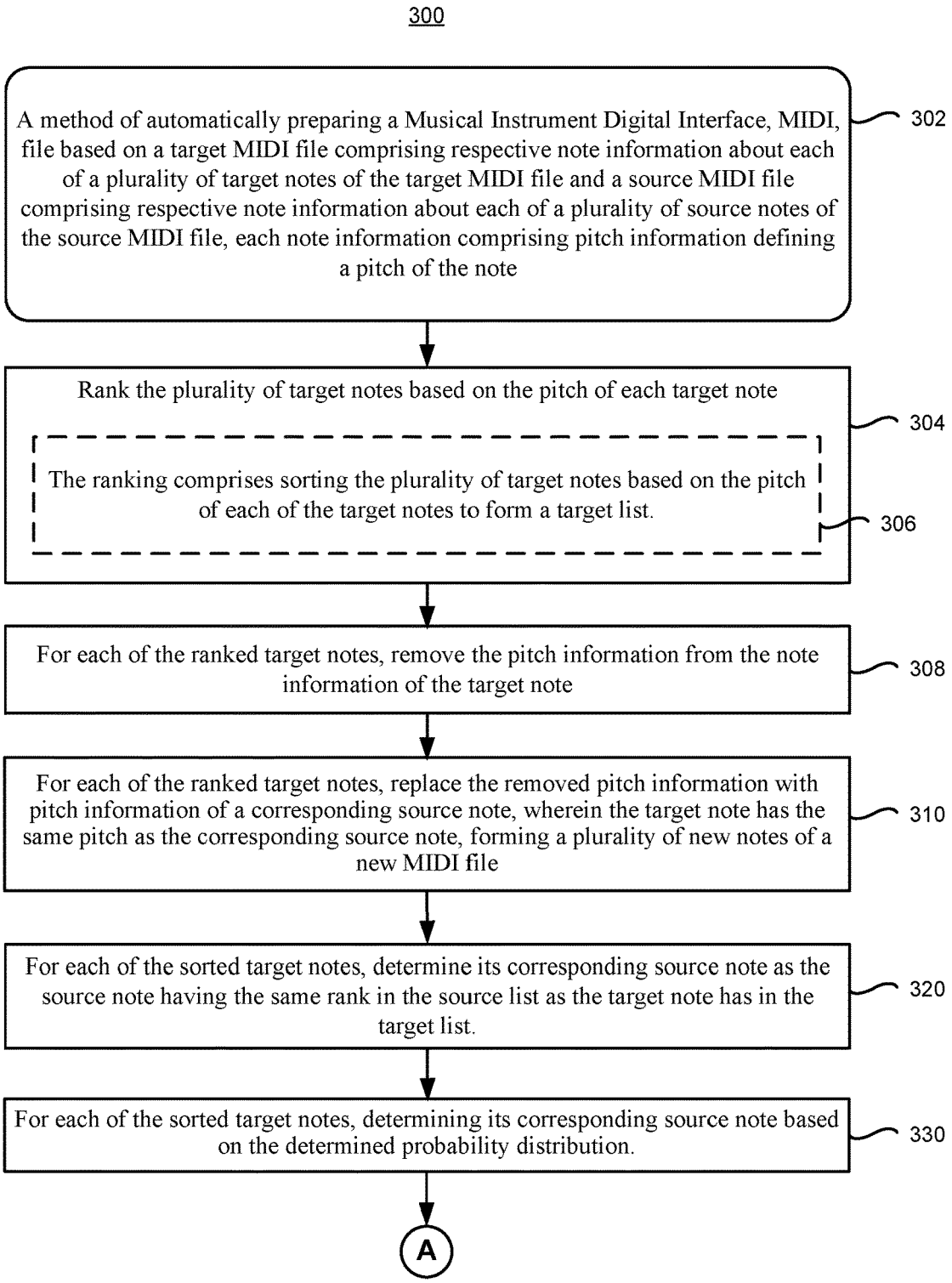
FIGS. 9A-9B is a schematic flow chart of an embodiment of a method of the present invention.
Figure 9B:
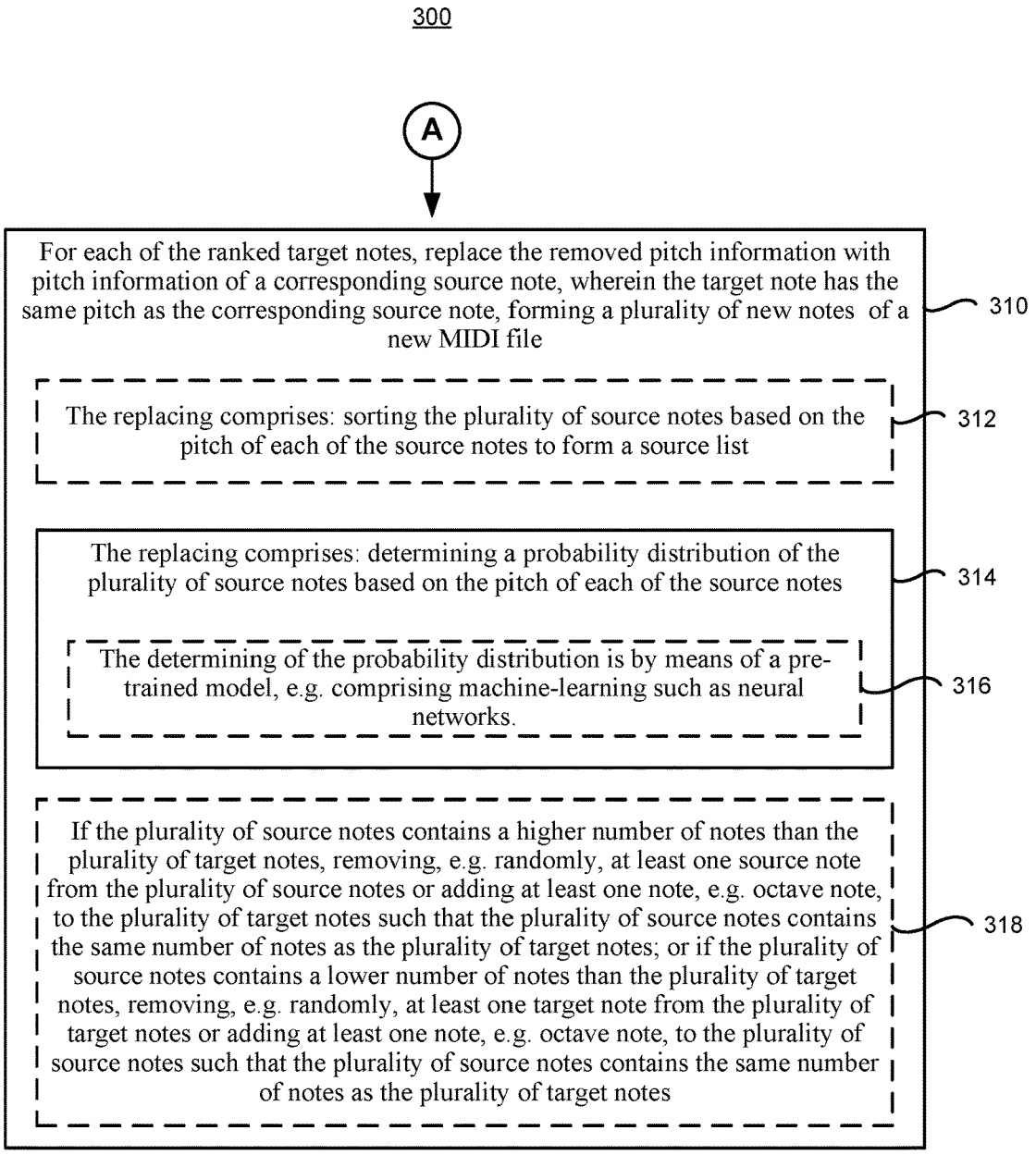

FIGS. 9A-9B illustrates flow charts of a method 300 for automatically preparing (302) a MIDI file based on a target MIDI file comprising respective note information about each of the target notes of the target MIDI file and a source MIDI file comprising respective note information about each of a plurality of source notes of the source MIDI file, each note information comprising pitch information defining a pitch of the note.

In some embodiments, the method 300 comprises block 304 which ranks the plurality of target notes based on the pitch of each target note. For example, the target notes may be ranked in ascending order from lowest pitch of each target note, to the highest pitch of each target note. Alternatively, the target notes may be ranked in descending order from highest pitch of each target note, to the lowest pitch of each target note. Alternatively, the pitch of each target note may be ranked according to a pre-selected or desired frequency, wherein the target notes are ranked according to which target notes have the closest frequency to the pre-selected or desired frequency.

In some embodiments, the method 300 further includes block 306 wherein the ranking comprising sorting the plurality of target notes based on the pitch of each target notes to form a target list. The list may be in ascending order, descending order, or in an order of proximity to the pre-selected or desired frequency.

In some embodiments, the method 300 further includes block 308 wherein for each of the ranked target notes, the pitch information is removed from the note information of the target note.

In some embodiments, the method further includes block 310 wherein for each of the ranked target notes, the removed pitch information is replaced with pitch information of a corresponding source note, wherein the target note has the same pitch as the corresponding source note, forming a plurality of new notes of a new MIDI file. In some embodiments, the corresponding source note has pitch information that is ranked. In some embodiments the pitch information of the source note is ranked in ascending order from lowest pitch of each source note, to the highest pitch of each source note. Alternatively, the source notes may be ranked in descending order from highest pitch of each source note, to the lowest pitch of each source note. Alternatively, the pitch of each source note may be ranked according to a pre-selected or desired frequency, wherein the source notes are ranked according to which source notes have the closest frequency to the pre-selected or desired frequency.

In some embodiments, block 320 is included wherein for each of the sorted target notes, the corresponding source note is determined as the source note having the same rank in the source list as the target note has in the target list. For example, once the source notes have been ranked, the ranked pitch information corresponding to the target note, and the ranked pitch information corresponding to the source note are matched based on the target list. In some embodiments, the highest pitch of the target note and the highest pitch of the source note are matched and the lowest pitch of the target note are matched. The pitch of the target note is then replaced with the matched pitch of the source note.

In some embodiments, the method further includes block 330 wherein for each of the sorted target notes, its corresponding source note is determined based on the determined probability distribution.

FIG. 9B illustrates further embodiments of block 310. In some embodiments, block 310 further comprises block 312 wherein the replacing comprises sorting the plurality of source notes based on the pitch of each of the source notes to form a source list.

In some embodiments, block 310 includes block 314 wherein the replacing comprises determining a probability distribution of the plurality of source notes based on the pitch of each of the source notes.

In some embodiments, block 314 further comprises block 316 wherein the determining of the probability distribution is by means of a pre-trained model. For example, the pre-trained model uses machine learning such as neural networks. In some embodiments, the pre-trained model will select and replace the correct target notes with the source notes depending on a pre-defined or desired pitch. For example, a deep neural network (DNN) is trained to predict the pitches of all the notes in a MIDI file with degraded pitch information. This is done by inputting the MIDI files from which the pitch information is degraded. The DNN predicts a probability vector of dimension for each note with degraded pitch information (e.g., one vector for each MIDI pitch in the MIDI format). The error is then measured by adding the distance between the predicted probability vector and a one hot vector with 1 for the actual pitch of the note for each note (i.e., the pitch in the original MIDI file). The distance may be any vector distance (e.g., root-mean squared).

In some embodiments, the pre-trained model is trained on short fragments (e.g., ranging from 1 beat to 2 measures). In some embodiments, the degradation of the pitch information may follow several strategies. In some embodiments, the first strategy (Strategy 1) is to remove the pitch information (e.g., each note being represented by its start time, its end time, its velocity, and a vector of dimension 128 with 0 everywhere). In some embodiments, the second strategy (Strategy 2) is the replacement of the pitch information by a ranking information (e.g., the lowest pitch is replaced by value 0, the second lowest by value 1, and so on). In some embodiments, the third strategy (Strategy 3) is to "blur" the pitch information (e.g., The actual pitch is $0 \leq p \leq 127$, this is replaced by a vector of dimension 128 with 0 everywhere except "near" p, e.g., the vector has 1 at indices $p-5, \ldots, p, \ldots, p+5$.

In some embodiments, the trained DNN is used to perform rhythm-harmony transfer between MIDI files. For example, given two MIDI fragments H and R of lengths similar to that used to train the DNN, an input T is created for the DNN by removing the pitch information from R following one of Strategy 1, Strategy 2, or Strategy 3. For each note with degraded pitch information in T, the DNN predicts a probability vector of dimension 128.

In some embodiments, block 310 further comprises block 318 wherein the replacing comprises if the plurality of source notes contains a higher number of notes than the plurality of target notes, removing, e.g. randomly, at least one source note from the plurality of source notes or adding at least one note, e.g. octave note, to the plurality of target notes such that the plurality of source notes contains the same number of notes as the plurality of target notes; or if the plurality of source notes contains a lower number of notes than the plurality of target notes, removing, e.g. randomly, at least one target note from the plurality of target notes or adding at least one note, e.g. octave note, to the plurality of source notes such that the plurality of source notes contains the same number of notes as the plurality of target notes. In some embodiments, the removal of the note is the lowest ranked note, or the highest ranked note. In another embodiment, the removal of the note is the farthest in proximity from a desired note.

Note that, in some embodiments, method 300 is performed for a plurality of portions of the source and target files. For example, method 300 is performed for temporally-aligned portions of the composition, such as beats or frames. Thus, the harmony for each frame of the target file is replaced by the harmony for a corresponding frame of the source file.

Embodiments of the present invention may be conveniently implemented using one or more conventional general purpose or specialized digital computer, computing device, machine, or microprocessor, including one or more processors, memory and/or computer readable storage media programmed according to the teachings of the present disclosure. Appropriate software coding can readily be prepared by skilled programmers based on the teachings of the present disclosure, as will be apparent to those skilled in the software art. In some embodiments, the present invention includes a computer program product 82 which is a non-transitory storage medium or computer readable medium (media) having instructions 83 stored thereon/in, in the form of computer-executable components or software (SW), which can be used to program a computer to perform any of the methods/processes of the present invention.

The present disclosure has mainly been described above with reference to a few embodiments. However, as is readily appreciated by a person skilled in the art, other embodiments than the ones disclosed above are equally possible within the scope of the present disclosure, as defined by the appended claims.

The invention claimed is:

1. A method of automatically preparing a Musical Instrument Digital Interface, MIDI, file based on a target MIDI file comprising respective note information about each of a plurality of target notes of the target MIDI file and a source MIDI file comprising respective note information about each of a plurality of source notes of the source MIDI file, each respective note information of a respective target note comprising pitch information defining a pitch of the respective target note and information for one or more non-pitch properties for the respective target note, the method comprising:

ranking the plurality of target notes based on the pitch of each respective target note into a sorted order;

and for each respective target note of the ranked target notes, replacing the pitch information with pitch information of a corresponding source note while maintaining the one or more non-pitch properties of the respective target note, the corresponding source note selected based on the corresponding source note having (i) a ranking in a sorted order of the plurality of source notes that is the same as (ii) a ranking of the respective target note in the sorted order of the plurality of target notes, thereby forming a plurality of new notes of a new MIDI file.

2. The method of claim 1, wherein the ranking the plurality of target notes comprises sorting the plurality of target notes based on the pitch of each of the target notes to form the sorted order.

3. The method of claim 2, wherein the replacing comprises:

sorting the plurality of source notes based on the pitch of each of the source notes to form a source list of the sorted order of the plurality of source notes.

4. The method of claim 1, further comprising:

if the plurality of source notes contains a higher number of notes than the plurality of target notes, removing at least one source note from the plurality of source notes or adding at least one note to the plurality of target notes such that the plurality of source notes contains the same number of notes as the plurality of target notes; and if the plurality of source notes contains a lower number of notes than the plurality of target notes, removing at least one target note from the plurality of target notes or adding at least one note to the plurality of source notes such that the plurality of source notes contains the same number of notes as the plurality of target notes.

5. The method of claim 1, wherein the one or more non-pitch properties for the respective target note include an onset of the respective note.

6. The method of claim 1, wherein the one or more non-pitch properties for the respective target note include a duration of the respective note.

7. The method of claim 1, wherein the one or more non-pitch properties for the respective target note include a velocity of the respective note.

8. The method of claim 1, wherein the one or more non-pitch properties for the respective target note include a timbre of the respective note.

9. A non-transitory computer-readable storage medium storing instructions, which, when executed by an electronic device with one or more processors, cause the one or more processors to perform a set of operations for automatically preparing a Musical Instrument Digital Interface, MIDI, file based on a target MIDI file comprising respective note information about each of a plurality of target notes of the target MIDI file and a source MIDI file comprising respective note information about each of a plurality of source notes of the source MIDI file, each respective note information of a respective target note comprising pitch information defining a pitch of the respective target note and information for one or more non-pitch properties for the respective target note, the set of operations comprising:

ranking the plurality of target notes based on the pitch of each respective target note;

and for each respective target note of the ranked target notes, replacing the pitch information with pitch information of a corresponding source note while maintaining the one or more non-pitch properties of the respective target note, the corresponding source note selected based on the corresponding source note having (i) a ranking in a sorted order of the plurality of source notes that is the same as (ii) a ranking of the respective target note in the sorted order of the plurality of target notes, thereby forming a plurality of new notes of a new MIDI file.

10. The non-transitory computer-readable storage medium of claim 9, wherein the ranking the plurality of target notes comprises sorting the plurality of target notes based on the pitch of each of the target notes to form the sorted order.

11. The non-transitory computer-readable storage medium of claim 9, further comprising:

if the plurality of source notes contains a higher number of notes than the plurality of target notes, removing at least one source note from the plurality of source notes or adding at least one note to the plurality of target notes such that the plurality of source notes contains the same number of notes as the plurality of target notes; and if the plurality of source notes contains a lower number of notes than the plurality of target notes, removing at least one target note from the plurality of target notes or adding at least one note to the plurality of source notes such that the plurality of source notes contains the same number of notes as the plurality of target notes.

12. The non-transitory computer-readable storage medium of claim 11, wherein the one or more non-pitch properties for the respective target note include one or more of the group consisting of an onset, a duration, a velocity, and a timbre of the respective note.

13. An electronic device configured to automatically prepare a Musical Instrument Digital Interface, MIDI, file based on a target MIDI file comprising respective note information about each of a plurality of target notes of the target MIDI file and a source MIDI file comprising respective note information about each of a plurality of source notes of the source MIDI file, each respective note information comprising pitch information defining a pitch of the respective target note and information for one or more non-pitch properties for the respective target note, the electronic device comprising:

one or more processors; and memory storing one or more programs, the one or more programs including instructions for:

ranking the plurality of target notes based on the pitch of each respective target note into a sorted order;

and for each respective target note of the ranked target notes, replacing the pitch information with pitch information of a corresponding source note while maintaining the one or more non-pitch properties of the respective target note, the corresponding source note selected based on the corresponding source note having (i) a ranking in a sorted order of the plurality of source notes that is the same as (ii) a ranking of the respective target note in the sorted order of the plurality of target notes, thereby forming a plurality of new notes of a new MIDI file.

14. The electronic device of claim 13, wherein the ranking the plurality of target notes comprises sorting the plurality of target notes based on the pitch of each of the target notes to form the sorted order.

15. The electronic device of claim 14, wherein the replacing comprises:

sorting the plurality of source notes based on the pitch of each of the source notes to form a source list of the sorted order of the plurality of source notes.

16. The electronic device of claim 13, wherein the replacing comprises further comprising:

if the plurality of source notes contains a higher number of notes than the plurality of target notes, removing at least one source note from the plurality of source notes or adding at least one note to the plurality of target notes such that the plurality of source notes contains the same number of notes as the plurality of target notes; and if the plurality of source notes contains a lower number of notes than the plurality of target notes, removing at least one target note from the plurality of target notes or adding at least one note to the plurality of source notes such that the plurality of source notes contains the same number of notes as the plurality of target notes.

17. The electronic device of claim 13, wherein the one or more non-pitch properties for the respective target note include an onset of the respective note.

18. The electronic device of claim 13, wherein the one or more non-pitch properties for the respective target note include a duration of the respective note.

19. The electronic device of claim 13, wherein the one or more non-pitch properties for the respective target note include a velocity of the respective note.

20. The electronic device of claim 13, wherein the one or more non-pitch properties for the respective target note include a timbre of the respective note.

* * * * *